US006014107A

United States Patent [19]

Wiesenfarth

[11] Patent Number: 6,014,107

[45] Date of Patent: Jan. 11, 2000

[54] DUAL ORTHOGONAL NEAR VERTICAL INCIDENCE SKYWAVE ANTENNA

[75] Inventor: Hans J. Wiesenfarth, San Diego, Calif.

[73] Assignee: The United States of America as represented by the Secretary of the Navy, Washington, D.C.

[21] Appl. No.: 08/977,712

[22] Filed: Nov. 25, 1997

[51] Int. Cl.[7] ..... H01Q 11/12

[52] U.S. Cl. ..... 343/742; 343/845; 343/867

[58] Field of Search ..... 343/866, 867, 343/855, 741, 742, 829, 842, 845, 846, 849; H01Q 11/12

[56] References Cited

U.S. PATENT DOCUMENTS

| | | | |
|---|---|---|---|
| 2,212,625 | 8/1940 | Thomas . | |
| 2,472,106 | 6/1949 | Hansen . | |
| 2,485,675 | 10/1949 | Taylor et al. | 343/867 |
| 3,082,421 | 3/1963 | Shyhalla . | |
| 3,483,563 | 12/1969 | Schroeder . | |
| 3,683,390 | 8/1972 | Cory et al. . | |
| 4,104,634 | 8/1978 | Gillard et al. . | |
| 4,288,794 | 9/1981 | Osborne et al. . | |
| 4,358,769 | 11/1982 | Tada et al. . | |
| 4,547,776 | 10/1985 | Bolt, Jr. et al. . | |
| 4,801,944 | 1/1989 | Madnick et al. . | |
| 5,081,468 | 1/1992 | Williams . | |
| 5,252,985 | 10/1993 | Christinsin . | |
| 5,315,309 | 5/1994 | Rudow et al. . | |
| 5,341,148 | 8/1994 | Walter et al. . | |
| 5,654,724 | 8/1997 | Chu | 343/742 |
| 5,764,195 | 6/1998 | Colclough et al. | 343/797 |
| 5,787,032 | 7/1998 | Johnston et al. | 343/702 |

*Primary Examiner*—Don Wong
*Assistant Examiner*—Tho Phan
*Attorney, Agent, or Firm*—Harvey Fendelman; Peter A. Lipovsky; Michael A. Kagen

[57] ABSTRACT

A dual orthogonal inverted L near vertical incidence skywave antenna includes two orthogonal RF loop elements coupled to a ground plane. The first RF loop element is mounted in a first plane and has first feed and ground nodes. The second RF loop element is mounted in a second plane substantially orthogonal to said first plane, and has second feed and ground nodes. The first and second elements are feed from a center feed node and are coupled to the ground plane at different locations. An important performance characteristic of the antenna is that it has no nulls in its azimuth pattern.

16 Claims, 6 Drawing Sheets

DUAL ORTHOGONAL NEAR VERTICAL INCIDENCE SKYWAVE ANTENNA

BACKGROUND OF THE INVENTION

The present invention generally relates to the field of antennas, and more particularly, to an antenna which includes two vertically oriented orthogonal RF loop elements coupled to a ground plane and has a common center feed.

Conventional HF communications use ground wave propagation up to about fifty miles. For long distance HF communication, sky wave propagation is used. HF antennas have been used for both modes of propagation. For communications between 50 and 300 miles, near vertical incidence skywave (NVIS) propagation is used. Antennas typically used for NVIS applications tend to be very large and bulky. For example, some of these antennas are in the shape of inverted conical spirals and require up to 6 masts to support them. The diameter of an entire antenna of this type may exceed 200 feet and have a height of 100 feet. Most of these antennas require resistive loads which are very bulky and expensive because they must be able to dissipate high power. Such resistive loads are also required for antennas of this type to have wide bandwidth performance.

Therefore, a present need exists for an NVIS antenna that requires minimal resistive loading, has relatively compact dimensions, can handle high power loads, and has a large frequency bandwidth ratio.

SUMMARY OF THE INVENTION

The present invention provides a dual orthogonal inverted L near vertical incidence skywave antenna that consists of two orthogonal radio frequency (RF) loop elements coupled to a ground plane. The antenna allows HF communication systems to receive and transmit at high elevation angles which is required for communications over distances from about fifty to three hundred miles. The first RF loop element is mounted in a first plane and has first feed and ground nodes. The second RF loop element is mounted in a second plane substantially orthogonal to the first plane, and has second feed and ground nodes. The first and second elements are fed from a single feed node and are coupled to the ground plane at the same location.

An important performance characteristic of the antenna is that it may be configured to have no nulls in its azimuth pattern.

Another important performance characteristic of the antenna is that it has a large bandwidth without any resistive loading. Since no high power loads are required, the antenna construction is simple and considerable cost savings may be realized compared to conventional antennas offering similar performance. Antenna efficiency is very high. Moreover, the antenna can handle high power loads.

Yet another advantage of the antenna is that is has a large frequency bandwidth ratio.

These and other advantages of the invention will become more readily apparent upon review of the accompanying description, including the claims, taken in conjunction with the attached drawings.

BRIEF DESCRIPTION OF THE DRAWINGS

Throughout the several views, like elements are referenced using like references.

DESCRIPTION OF THE PREFERRED EMBODIMENT

Figure 1:
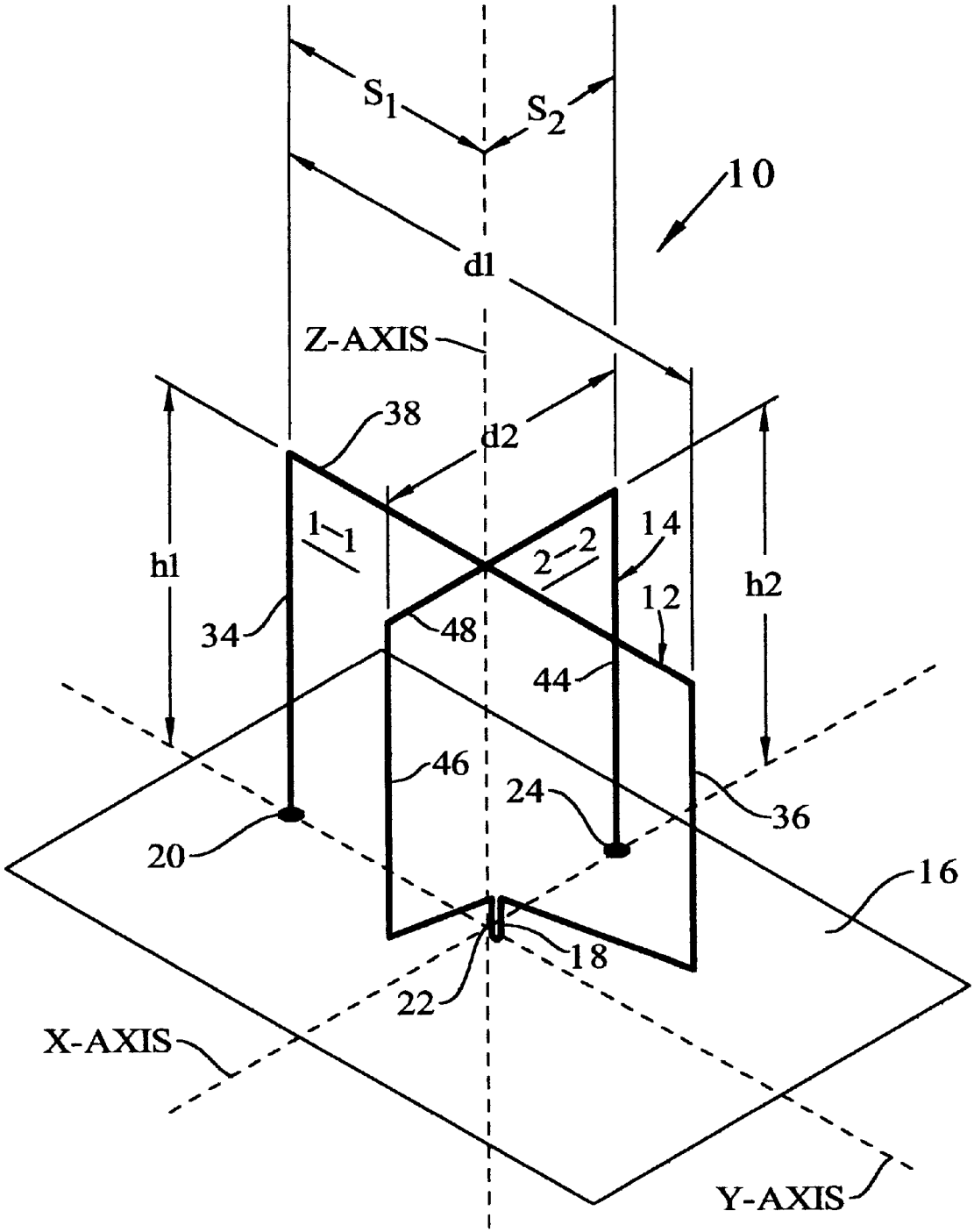
FIG. 1 is a perspective view of a dual orthogonal inverted L near vertical incidence skywave antenna embodying various features of the present invention.

Referring to FIG. 1, there is shown a dual orthogonal inverted L near vertical incidence skywave (NVIS) antenna 10, comprising: an RF loop element 12, an RF loop element 14, and a ground plane 16. The loop elements 14 and 16 may be fabricated from steel wire or other electrically conductive materials. The wire may have a ¼ inch diameter cross-section, or any other suitably sized and shaped cross-section required for a particular application. RF loop element 12 is mounted in a first vertical plane 1—1 and includes a feed node 18 and ground node 20. RF loop element 14 is mounted in a second vertical plane 2—2 which is substantially orthogonal to the vertical plane 1—1. RF loop element 14 has feed node 22 and ground node 24. Ground plane 16 is coupled to ground nodes 20 and 24.

Figure 2:
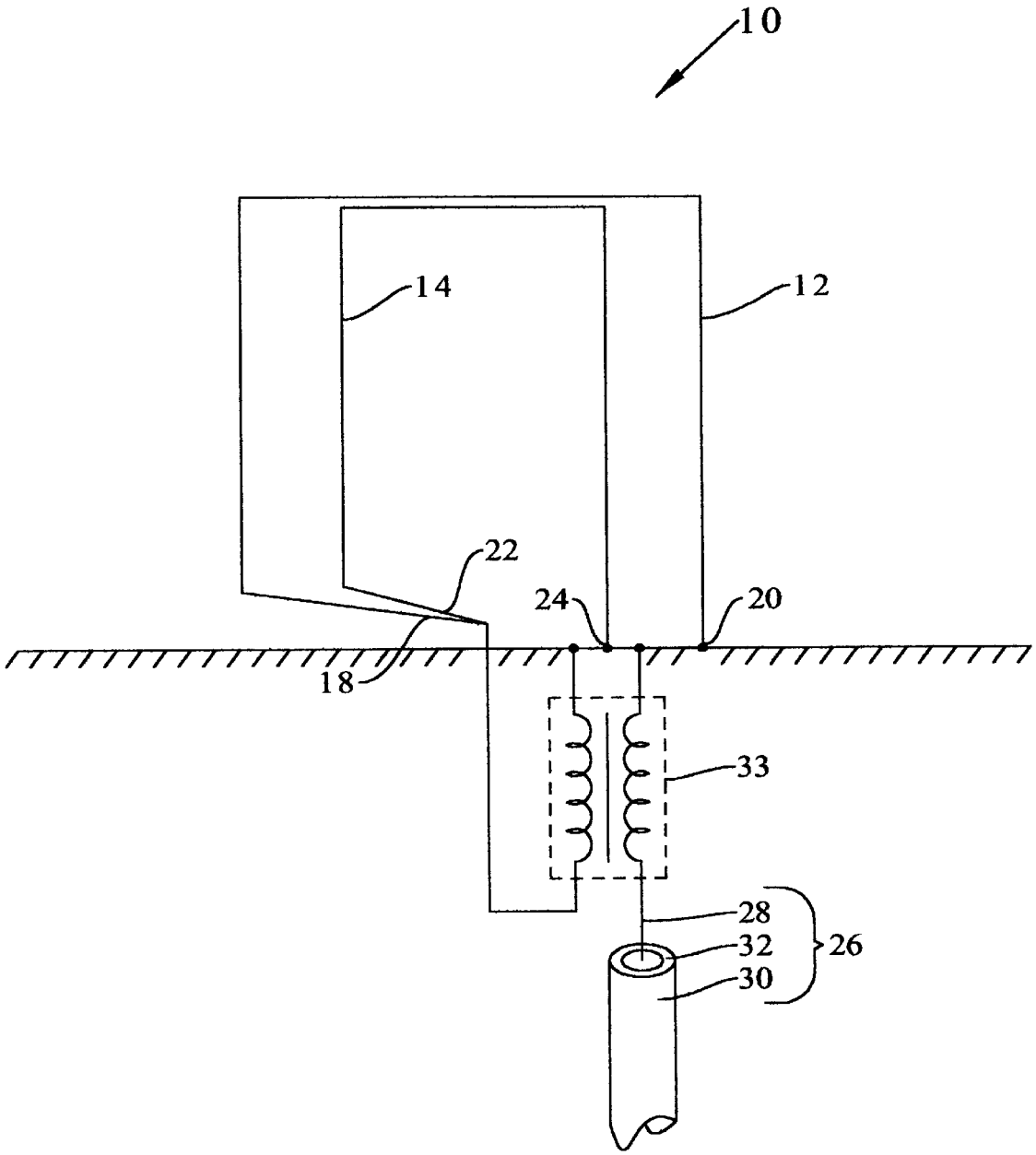
FIG. 2 is an elevation view of the antenna of FIG. 1.

Referring to FIG. 2, when operated in a transmitting mode, an RF signal is provided to antenna 10 by coaxial feed 26 which includes an inner conductor 28 electrically isolated from an outer conductor 30 by an insulating layer 32 interposed therebetween. Inner conductor 28 is coupled to feed nodes 22 and 18 through transformer 33 which is used to balance the antenna load. Inner conductor 28 receives RF energy from antenna 10 through feed nodes 18 and 22, and through transformer 33 when antenna 10 is operated in a receiving mode is further coupled to feed nodes 18 and 22. Inner conductor 28 provides RF energy to antenna 10 through feed nodes 18 and 22, and through transformer 33 when antenna 10 is operated in a transmitting mode. Outer conductor 30 couples RF ground plane 16 to ground nodes 20 and 24 of loop elements 12 and 14, respectively. The ground plane 16 may be implemented as a wire mesh screen or as wires arranged in a radial pattern formed on a flat substrate. The ground plate 16 may also be implemented as a metal plate, or as a flat substrate on which a metal foil is mounted.

RF loop element 12 may be generally symmetrical about a reference axis, referred to as the Z-axis in the ensuing description, which may for example, be a vertical reference axis, where the Z-axis is substantially coincident with the intersection of planes 1—1 and 2—2. RF loop element 12 has two parallel sections 34 and 36 which define plane 1—1. The sections 34 and 36 are connected by a section 38 having a length $d_1$, which is orthogonal to sections 34 and 36. Section 38 is coincident with plane 1—1. The sections 34 and 36 may each have a height, $h_1$.

RF loop element 14 may be generally symmetrical about the Z-axis and has two parallel sections 44 and 46 which define plane 2—2. The sections 44 and 46 are connected by a section 48 having a length $d_2$, which is orthogonal to sections 44 and 46. Section 48 is coincident with plane 2—2. Sections 44 and 46 may each have a height, $h_2$. In one embodiment of the invention, $d_1$ may be substantially equal to $d_2$, expressed mathematically as $d_1 \cong d_2$. In the preferred embodiment, $h_1 \cong h_2$, $d_1$=34 feet, and $h_1$=40 feet. However, it is to be understood that there may be some applications wherein $d_1 \neq d_2$.

Since no resistive loading is used, antenna 10 has an efficiency close to 100 per cent. Moreover, antenna 10 has a very large frequency bandwidth ratio, on the order of 10:1 or more, which cover almost the entire HF band from 2 to 32 MHZ.

may be asymmetrical with respect to the Z-axis, where with reference to FIG. 1, $s_2 \neq d_2/2$.

Obviously, many modifications and variations of the present invention are possible in light of the above teachings. For example, for ship board applications, the lengths $d_1$ and $d_2$ may not necessarily be equal in order for the antenna to fit within the limited spaces available on the topsides of ships. In such cases, the radiation pattern may not be omnidirectional. In applications at the higher HF frequencies, the dimensions of the antenna may be reduced accordingly. It is therefore to be understood that within the scope of the appended claims, the invention may be practiced otherwise than as specifically described.

TABLE I

NEC-4 DATA FILE FOR:
DUAL ORTHOGONAL INVERTED NEAR VERTICAL INCIDENCE SKYWAVE (NVIS) ANTENNA
DESIGNED FOR THE HF FREQUENCY BAND 2 TO 32 MHZ
NOTE: ALL DIMENSIONS ARE IN FEET
FREQUENCIES IN MHZ

| | | | | | | | | | |
|---|---|---|---|---|---|---|---|---|---|
| CEL181-001;L13G.IN:INVERTED L;FOLDED;DUAL;SYM (N = 2);F = 2–32 MHZ; 2/15/94 | | | | | | | | | |
| GW | 99, | 1, | 0.00, | 0.00, | 0.00, | 0.00, | 0.00, | 1.0, | 0.020833 |
| GW | 1, | 4, | 0.00, | 0.00, | 1.00, | 20.00, | 0.00, | 4.0, | 0.020833 |
| GW | 2, | 4, | 0.00, | 0.00, | 1.00, | 0.00, | 20.00 | 4.0, | 0.020833 |
| GW | 3, | 6, | 20.00, | 0.00, | 4.00, | 20.00, | 0.00, | 34.0, | 0.020833 |
| GW | 4, | 6, | 0.00, | 20.00, | 4.00, | 0.00, | 20.00 | 33.0, | 0.020833 |
| GW | 10, | 4, | −20.00, | 0.00, | 34.00, | 20.00, | 0.00, | 34.0, | 0.020833 |
| GW | 20, | 4, | 0.00, | −20.00, | 33.00, | 0.00, | 20.00, | 33.0, | 0.020833 |
| GW | 5, | 6, | −20.00, | 0.00, | 0.00, | −20.00, | 0.00, | 34.0, | 0.020833 |
| GW | 6, | 6, | 0.00, | −20.00, | 0.00, | 0.00, | −20.00 | 33.0, | 0.020833 |
| GS | 0, | 0, | 0.3048 | | | | | | |
| GE | 1 | | | | | | | | |
| GN | 1 | | | | | | | | |
| FR | 0, 1, 0, 0, 2.0, 0.25 | | | | | | | | |
| EX | 0, 99, 1, 0, 1.0, 0.0 | | | | | | | | |
| RP | 0, 181, 1, 1301, −90.0, 0.0, 1.0, 0.0 | | | | | | | | |
| RP | 0, 1, 181, 1301, 30.0, 0.0, 0.0, 2.0 | | | | | | | | |
| XQ | | | | | | | | | |
| EN | | | | | | | | | |

Figure 3:
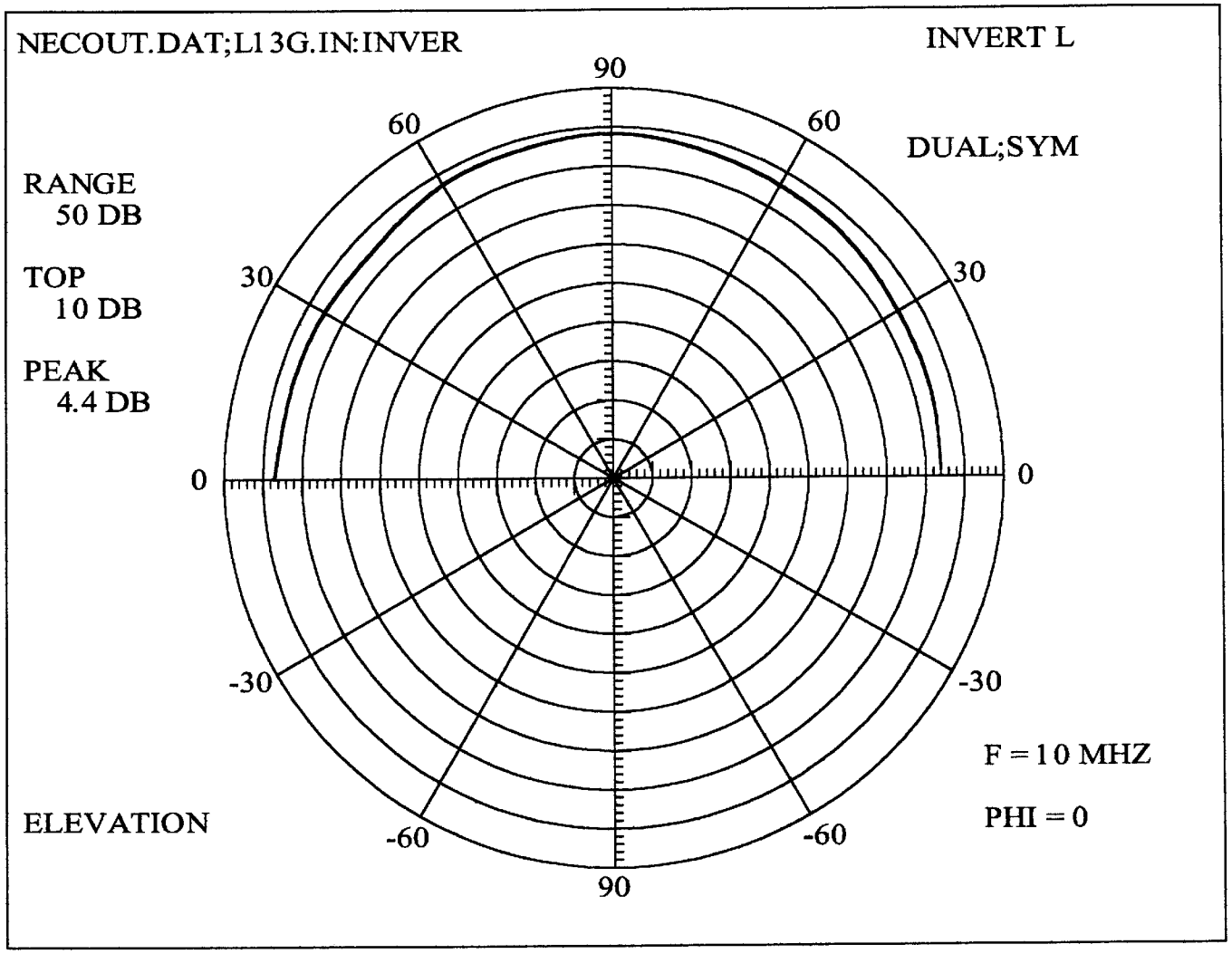
FIG. 3 illustrates an example of a simulated radiation pattern in the elevation plane for the antenna operating at 10 MHZ.
Figure 4:
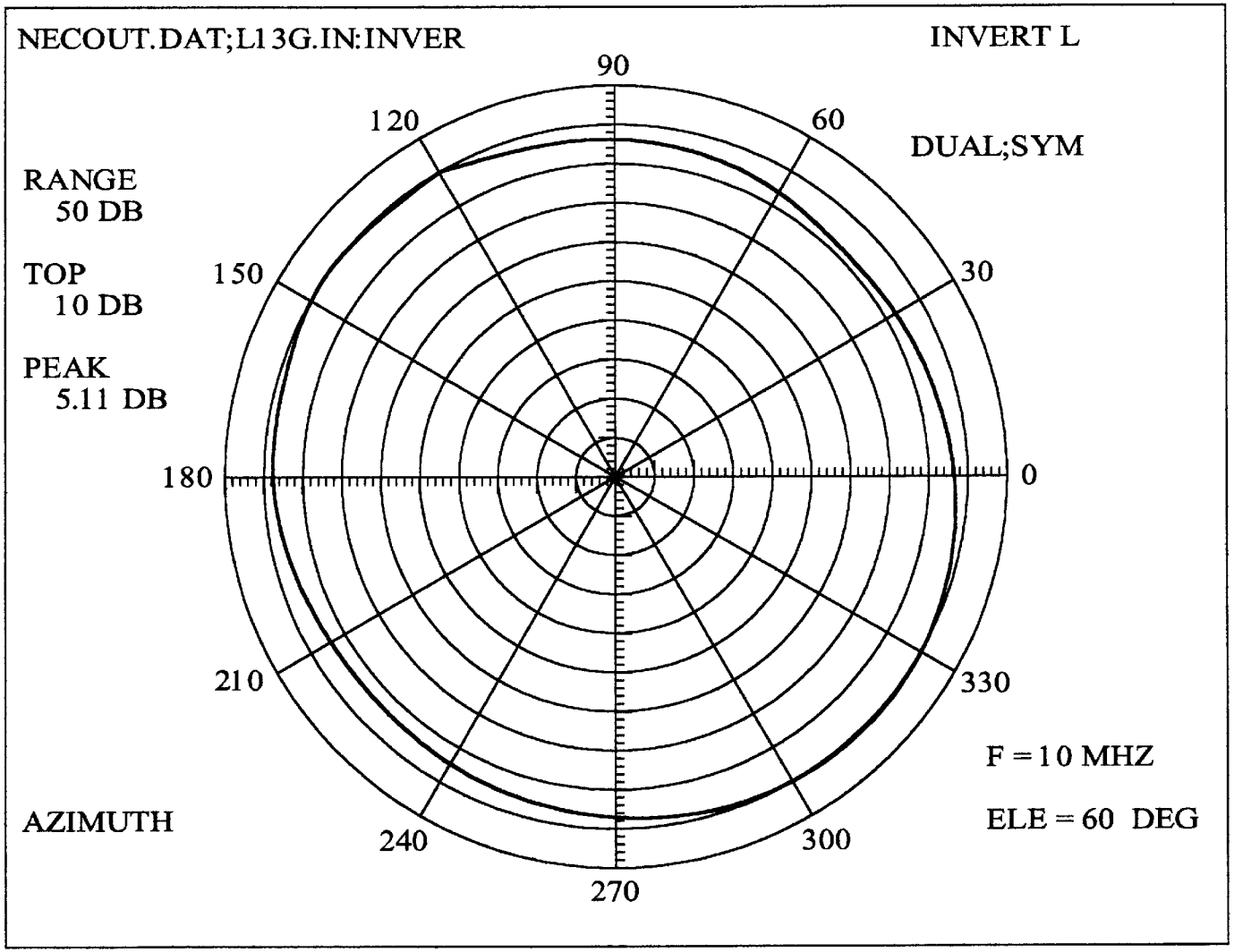
FIG. 4 illustrates a simulated radiation pattern in the azimuth direction for the antenna operating at 1 MHZ.
Figure 5:
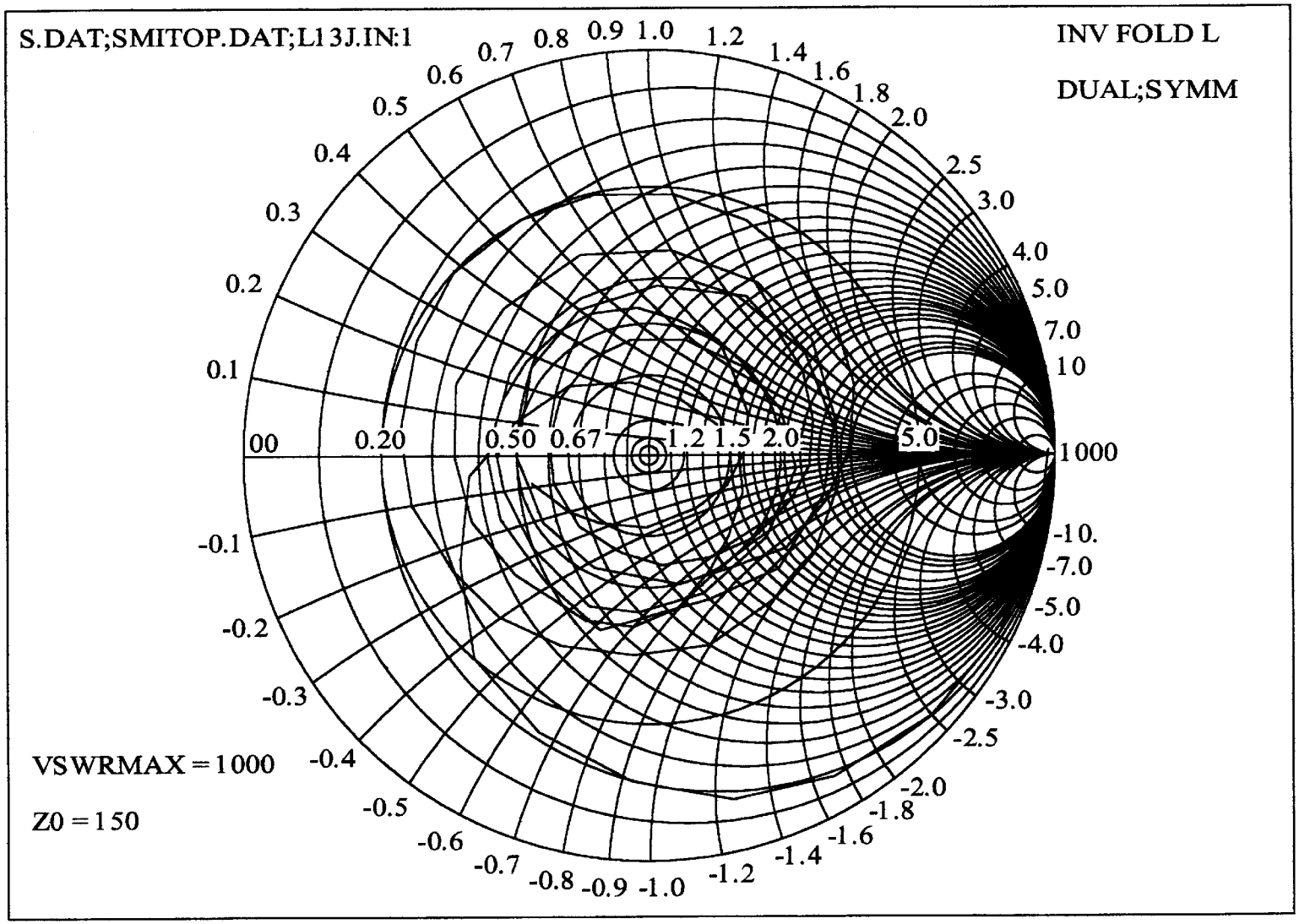
FIG. 5 is a simulated Smith Chart for the antenna at 10 MHZ.
Figure 6:
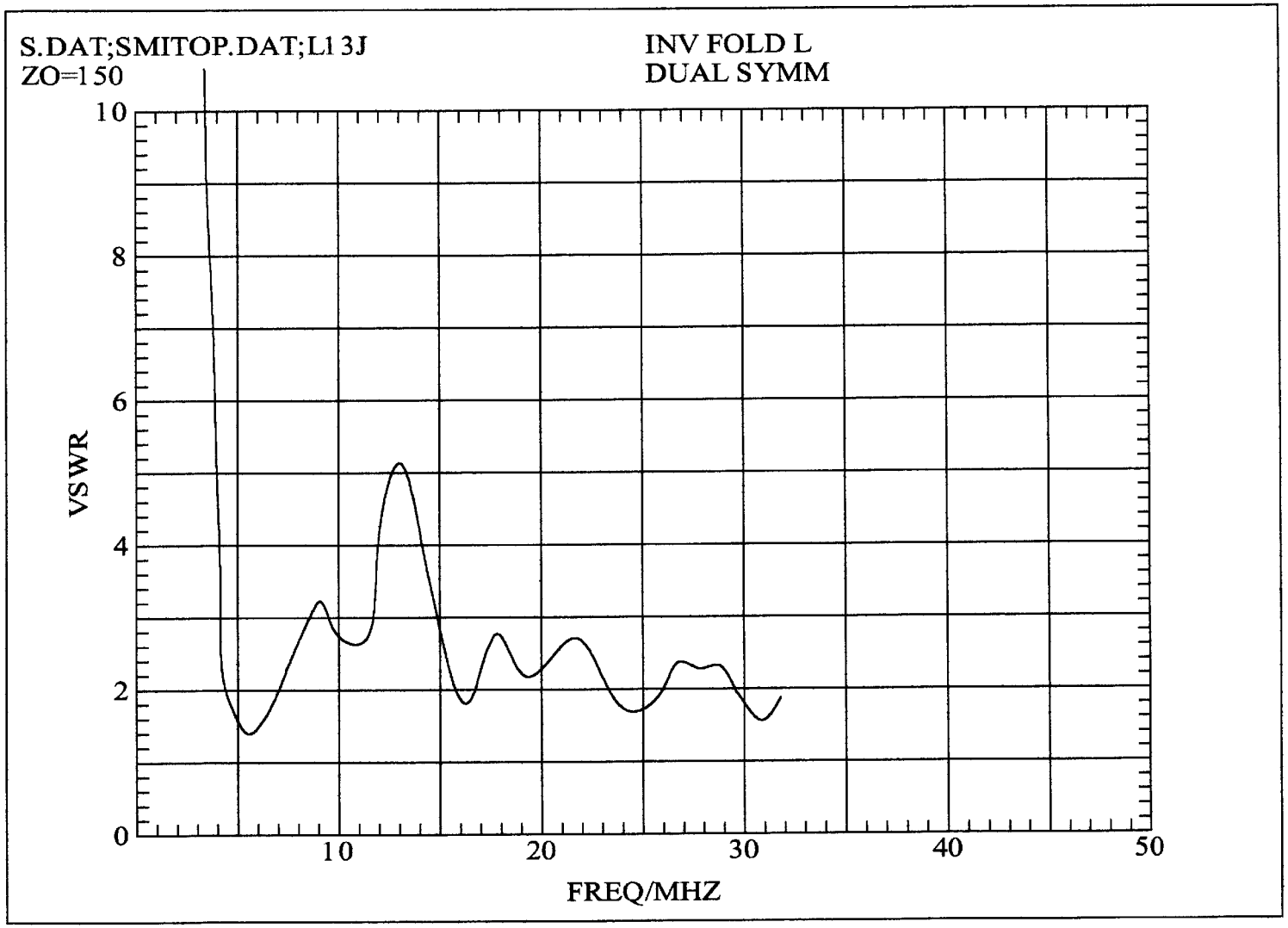
FIG. 6 shows simulated VSWR characteristics of the antenna as a function of frequency.

Performance characteristics for the antenna 10 were predicted using an antenna simulation program known as NEC-4®. Table I shows examples of input parameters to NEC-4® for an antenna designed to operate in the HF frequency band of 2 to 32 MHZ. FIG. 3 shows a simulated radiation pattern in the elevation plane for antenna 10 operating at 10 MHZ. FIG. 4 shows a simulated radiation pattern in the azimuth direction for antenna 10, also operating at 10 MHZ. The pattern in FIG. 4 is dual polarized and mostly omnidirectional, which means that there are no nulls in any direction and orientation. FIG. 5 is a Smith Chart for antenna 10 which shows simulated complex impedance characteristics of antenna 10 as a function of frequency. FIG. 6 shows simulated VSWR characteristics of antenna 10 as a function of frequency. The frequency range extends from 4 to 32 MHZ with a VSWR of less than 3:1, except between 12 and 14 MHZ. In an example of one implementation of antenna 10 in which coaxial feed 26 has a 50 ohm impedance, impedance transformer 33 (FIG. 2) may have a ratio of 1.732:1. In an example of another implementation of the invention, antenna 10 may be fed by a balanced 300 ohm transmission line, where transformer 33 preferably has a ratio of 0.701:1.

In other embodiments of antenna 10, RF loop element 12 may asymmetrical with respect to the Z-axis, where with reference to FIG. 1, $s_1 \neq d_1/2$. Similarly, RF loop element 14

I claim:

1. A dual orthogonal inverted L near vertical incidence skywave antenna, comprising:

an RF ground plane;

a first RF loop element which defines a first plane, and has a first feed node a first ground node coupled to said ground plane, first opposed side sections that extend to a distance $h_1$ from said ground plane, wherein said first RF loop element intersects a reference axis coincident with said first plane; and a second RF loop element which defines a second plane that is substantially orthogonal to said first plane and coincident with said reference axis, and has second feed node a second ground node coupled to said ground plane, second opposed side sections that extend to a distance $h_2$ from said ground plane, wherein said second RF loop element intersects said reference axis, and said first RF loop element is separate from said second RF loop element between said distances $h_1$ and $h_2$.

2. The dual orthogonal inverted L near vertical incidence skywave antenna of claim 1 wherein said first and second feed nodes are coupled together.

3. The dual orthogonal inverted L near vertical incidence skywave antenna of claim 1 further including having a coaxial feed which includes an inner conductor electrically isolated from an outer conductor where said inner conductor is coupled to said first and second feed nodes, and said outer conductor is coupled to said RF ground plane.

4. The dual orthogonal inverted L near vertical incidence skywave antenna of claim 1 wherein said first RF loop element is generally symmetrical about said reference axis.

5. The dual orthogonal inverted L near vertical incidence skywave antenna of claim 1 wherein said second RF loop element is generally symmetrical about said reference axis.

6. The dual orthogonal inverted L near vertical incidence skywave antenna of claim 1 wherein said first opposed side sections are separated by a distance $d_1$ and said second opposed side sections are separated by a distance $d_2$, where $d_1 \sim d_2$.

7. The dual orthogonal inverted L near vertical incidence skywave antenna of claim 1 wherein said first RF loop element is generally asymmetrical about said reference axis.

8. The dual orthogonal inverted L near vertical incidence skywave antenna of claim 1 wherein said second RF loop element is generally asymmetrical about said reference axis.

9. A dual orthogonal inverted L near vertical incidence skywave antenna, comprising:

an RF ground plane;

a first RF loop element which defines a first vertical plane and has a first feed node, a first ground node coupled to said ground plane, first opposed side sections that extend to a distance $h_1$ from said ground plane, wherein said first RF loop element intersects a vertical reference axis coincident with said first plane; and a second RF loop element which defines a second vertical plane that is substantially orthogonal to said first vertical plane and coincident with said vertical reference axis, and has a second feed node a second ground node coupled to said ground plane, second opposed side sections that extend to a distance h2 from said ground plane, wherein said second RF loop element intersects said vertical reference axis, and said first RF loop element is separate from said second RF loop element between said distances $h_1$ and $h_2$.

10. The dual orthogonal inverted L near vertical incidence skywave antenna of claim 9 further including having a coaxial feed which includes an inner conductor electrically isolated from an outer conductor where said inner conductor is coupled to said first and second feed nodes, and said outer conductor is coupled to said RF ground plane.

11. The dual orthogonal inverted L near vertical incidence skywave antenna of claim 9 wherein said first RF loop element is generally symmetrical about said vertical reference axis.

12. The dual orthogonal inverted L near vertical incidence skywave antenna of claim 3 wherein said second RF loop element is generally symmetrical about said vertical reference axis.

13. The dual orthogonal inverted L near vertical incidence skywave antenna of claim 9 wherein said first opposed vertical sections are separated by a distance $d_1$ and said second opposed vertical sections are separated by a distance $d_2$, where $d_1 \sim d_2$.

14. The dual orthogonal inverted L near vertical incidence skywave antenna of claim 3 wherein said first RF loop element is generally asymmetrical about said vertical reference axis.

15. The dual orthogonal inverted L near vertical incidence skywave antenna of claim 9 wherein said second RF loop element is generally asymmetrical about said vertical reference axis.

16. A dual orthogonal inverted L near vertical incidence skywave antenna, comprising:

an RF ground plane;

a first RF loop element which defines a first plane, and has a first feed node, a first ground node coupled to said ground plane, first opposed side sections that extend to a distance $h_1$ from said ground plane, wherein said first RF loop element intersects a reference axis coincident with said first plane; and a second RF loop element which defines a second plane that is substantially orthogonal to said first plane and coincident with said reference axis, and has a second feed node, a second ground node coupled to said ground plane, second opposed side sections that extend to a distance $h_2$ from said ground plane, wherein said second RF loop element intersects said reference axis, and said first RF loop element is separate from said second RF loop element between said distances $h_1$ and $h_2$, wherein said antenna has an omnidirectional radiation pattern in the azimuth direction when said antenna is operating.

* * * * *